United States Patent [19]

Roeschlein et al.

[11] 4,334,732

[45] Jun. 15, 1982

[54] ELECTRICAL CONNECTOR UNIT

[75] Inventors: Rolf Roeschlein, Paderborn; Udo Tewes, Paderborn-Elsen; Rüdolf Schmeykal, Neuenbeken, all of Fed. Rep. of Germany

[73] Assignee: Nixdorf Computer AG, Paderborn, Fed. Rep. of Germany

[21] Appl. No.: 138,776

[22] Filed: Apr. 10, 1980

[30] Foreign Application Priority Data

Apr. 12, 1979 [DE] Fed. Rep. of Germany ..... 2915046
Mar. 25, 1980 [DE] Fed. Rep. of Germany ..... 3011508

[51] Int. Cl.[3] ..... H01R 13/54
[52] U.S. Cl. ..... 339/176 MP
[58] Field of Search ..... 339/64, 176 MP, 206, 339/207, 209, 210, 128

[56] References Cited

U.S. PATENT DOCUMENTS

| | | | |
|---|---|---|---|
| 2,946,033 | 7/1960 | Wirth, Jr. | 339/128 X |
| 3,486,163 | 12/1969 | Vuyst et al. | 339/64 R |
| 3,903,458 | 9/1975 | Arnoux | 339/128 X |
| 4,118,094 | 10/1978 | Key | 339/176 MP X |
| 4,119,357 | 10/1978 | Bonhomme | 339/176 MP X |

*Primary Examiner*—John McQuade
*Assistant Examiner*—Frank H. McKenzie, Jr.
*Attorney, Agent, or Firm*—Krass, Young & Schivley

[57] ABSTRACT

A multi-circuit connector (5) to receive edge contacts of plug-in modules (4) and make electrical contacts with a printed board (2). The connector (5) comprises means (20) to achieve a floating mount in a support (11) having lateral spring tabs (19) and contact clips (6) which project forwardly in parallel rows to make circuit with the board (2). The clips (6) are bent (24) to improve resilience along their own axis to reduce stress on the board (2) when a male module (4) is inserted. Two or more embodiments are disclosed.

28 Claims, 10 Drawing Figures

ELECTRICAL CONNECTOR UNIT

DESCRIPTION

1. Technical Field

This invention relates to an electrical connector unit with female multipoint connectors which can be fastened onto a rack, the contact clips of which connectors are electrically connected, e.g., by soldering, with the printed conductor of a printed wiring board on the one hand, and on the other hand may make contact with spring contact strips, carrying connecting contacts, of the electrical plug-in modules which can be slipped onto the female multipoint connector.

2. Background Art

In known electrical connector units of the above-mentioned type, a number of female multipoint connectors carrying contact clips and arranged in rows are fastened parallel to one another or in rows parallel to one onto a rack, a plate-like one for example. The contact clips of the female multipoint connector have metallic contact elements which form plugs on the front side of the rack, can be slipped onto the electrical components or electrical assemblies, and which on the opposite side, that is in the region of the back side of the frame, are constructed as terminal lugs or soldering lugs which are connected, e.g., by soldering, with a more or less large-surface-area rack wiring, e.g. in the form of printed wiring boards. For this the principle is known of fastening the female multipoint connector onto the rack by a screw attachment with a slight play in such a way that the female multipoint connectors are slightly movable in the plane of the rack. Moreover, the principle is known of providing the female multipoint connector with hook-like catch devices instead of screw connections in such a way that the female multipoint connector, from the front side of the rack, can be slipped on the rack, which is provided with corresponding openings, and secured there. In all these connector units the attempt is made to make the mounting of the female multipoint connectors as flexible as possible in order to be able to compensate for deviations in position between the plug-in members of the electrical plug-in modules, especially when guide bars rigidly fastened to the rack for these plug-in modules exist, where there is a mechanical connection of plug-in module and female multipoint connector. These attempts are opposed by the requirement of fastening the contact clips of the female multipoint connectors as rigidly as possible, in order thereby to prevent any mechanical stress, especially any alternating stress on the junctions, e.g. soldered junctions between the contact clip ends and the wiring, for example the printed conductors of the printed wiring boards.

DISCLOSURE OF THE INVENTION

The present invention is based on the problem of designing an electrical connector unit of the type mentioned at the start in such a way that, in order to compensate for deviations in position between a predetermined or non-predetermined plug-in path of the electrical plug-in modules, an extensive freedom of movement of the female multipoint connector is provided, and that despite this, any damaging mechanical stress on the junctions, e.g., on the soldered junctions, can be avoided to a very large extent.

This problem is solved according to the invention by having each female multipoint connector supported floating in a support member, which in the priority document is called a plug board which can be secured to the rack, and by having the contact clips of the female multipoint connector constructed to be elastically yielding in a plurality of directions in the region between their junctions on the printed wiring board and their contact points. The flexibility toward mechanical stresses which is given by the contact clips now offers the capability of supporting in a floating manner the female multipoint connectors having the contact points of the connection unit in such a way that they exhibit a maximum freedom of movement during the connection process, in which way there can be no fear of any mechanical stress or load on the junctions, for instance the soldered junctions.

In a preferred embodiment, the invention further provides a particularly simple construction of the connector unit described generally in the foregoing, which consists of few component parts, is simple to mount and offers the greatest possible safety of operation.

This problem is solved according to the invention by having the female multipoint connector and the contact clip guide each consist of two reversely similar half connectors which are connected together after the insertion of the contact clips of one series, which connectors exhibit a chamber formed by the lengthwise side of the half connector and the transverse flanges assigned to them for each contact clip, that the chambers of the contact clip guide absorb only the deformation of the particular contact clip and that the contact clip guide is coupled with the female multipoint connector with play.

The invention makes possible the construction of a connector unit of the type mentioned at the start with only four prefabricated component parts, namely the half connectors of the female multipoint connector and the contact clip guide. These four component parts may be produced from plastic by the injection molding technique. The contact clips are inserted into the chambers of the half connectors upon assembly, whereafter the half connectors are then joined together. They may be connected by bolting for example or else by welding, which depends on whether the connector unit is to be taken apart at a later time or not. It is advantageous for the contact clips to be unreleasably attached to the respective half connector at predetermined places, which can be done by ultrasound waves for example.

The connector unit, despite its simplicity, makes it possible for a female multipoint connector to be mounted floating in a rack, and despite this the contact clips are directly connected with a printed wiring board. Any possible movements of the female multipoint connector relative to the printed wiring board are absorbed by the deformation of the contact clips which are secured reliably against sidewise shifts in the chambers of the contact clip guide. Since the female multipoint connector is coupled with the contact clip guide with clearance, its movements within a certain range are not transmitted to the contact clip guide and the connections between the contact clips and a printed wiring board are not strained.

An advantageous further development is notable in that each half connector of the female multipoint connector is provided with a retaining strip for fixing the contact clips which strip is placed behind their contact segments in the plug-in direction and on the contact clips in the lengthwise direction of the half connector and is firmly attached to it. This retaining strip serves for the secure fixing of the contact clips onto the respective half connectors of the female multipoint connector, since the contact clips are enclosed between them and the respective lengthwise surface of the half connection and thus retained especially securely.

Each half connector of the female multipoint connector may show a lengthwise rib turned toward the contact clips under the retaining strip, on which the respective contact clip, with a crease formed in it, is placed.

By means of this further development a particularly secure position of the respective contact clip is achieved, since the crease combined with the lengthwise rib brings about an acceptable securing of the respective contact clip against any lengthwise movements in the plug-in direction.

The retaining strip can show a gradation of such a kind that it rests on the crease on the one hand and on the other hand rests on a segment of a contact clip behind the crease. Thereby the enclosing of the respective contact clip between the retaining strip and the lengthwise surface of the half connector is improved still further, while at the same time any play between the crease of the respective contact clip and the lengthwise rib is eliminated, so that even the slightest movements of the respective contact clip in its lengthwise direction are prevented.

At least one half connector of the contact clip guide may show a lengthwise flange behind their chambers in the plug-in direction, on which flange the contact clips lie and which flange shows teeth between each two contact clips, which teeth may be coupled with the opposite teeth of the other half connector or with its lengthwise flange.

This further development ensures as especially secure seating of the contact clips on the contact clip guide, since the contact clips resting on the lengthwise flange may be unreleasably attached to this, by ultrasonic welding for example, in which way the respective deformation of a contact spring is nonetheless still movable within the respective assigned chamber of the contact clip guide. The teeth serve as a spacer between the contact clips and as a junction element for fastening the two half connectors of the contact clip guide to one another.

It is advantageous for the contact clips to be toothed in their segment lying on the lengthwise flange. In this way an especially intimate connection between the material of the contact clip guide and the respective contact clip is possible.

In order to make the coupling between the contact spring guide and the female multipoint connector with play particularly simple to achieve, the half connectors are each provided on one end with a coupling element for connecting female multipoint connector and contact clip guide in such a way that a coupling occurs on both ends of the unit. This leads to particularly simple component parts, since each half connector need show a coupling element on only one end, so that in joining together a pair of half connectors, the body thus formed shows one coupling element each on both ends.

According to another embodiment of the invention, each support member shows at least two catch hooks locking in opposite directions for securing it to the rack on the one hand and to the printed wiring board on the other. With this the effective forces brought about when the plug-in module is plugged in are wholly transmitted to the stable rack by way of the catch hooks secured on the rack, while when the plug-in module is unplugged, the pulling forces are absorbed by the printed wiring board by way of the corresponding catch hook. There is no mechanical stress put on the connections or soldered junctions.

According to another development of the invention, the female multipoint connector is supported floating between spring flaps formed between at least two opposite sides of the support member. According to a preferred embodiment, the female multipoint connector is guided in a movable manner, by means of projections, in slots extending perpendicularly to the plug-in direction of the plug-in module. By having the spring flaps punched out of the support member, the advantage is offered that the projections can be guided in slots extending along the free spring ends which slots are formed by the punching out of the spring flap. In this way the female multipoint connector, when the plug-in module is plugged in along a plug-in path differing from the ideal plug-in path, can very easily give way and adapt itself to the actual position of the spring contact strip of the plug-in module, in which way any transmission of the yielding motion to the junctions or soldered junctions is prevented by the flexibility of the contact clips.

A very extensive flexibility of the contact clips with respect to the motions and forces acting on them is made possible in a further development of the invention by having each of the preferably flat-belt-shaped or leaf spring-like, contact clips of the female multipoint connector show a meander-shaped, zigzag or spiral-shaped spring loop formed between the junction and contact points. The flexibility of the contact clips in each direction is improved still further by having the contact clip, consisting of a flat-belt-shaped material, twisted by about 90° between the junction and the contact position.

According to a further development of the connector unit according to the invention, each female multipoint connector carries two parallel rows, spaced apart from one another, of contact clips projecting out freely over the female multipoint connector, between the free connection-side ends of which clips may be inserted, a guide comb showing guide slots for the contact clips on the boundary edges opposite one another, the comb being detachably connected with the female multipoint connector. In this way the contact clip ends which extend out freely relatively far over the female multipoint connector, are secured against bending and are fixed in the guide grooves of the guide comb in such a position that they may be introduced without difficulty, for example, into the soldered eye pattern of the printed wiring board. The contact clip ends, also called "contact pins" are thus retained in a predetermined desired position. A further positional fixing of the contact clip ends is made possible by having retaining strips which can be slipped onto the boundary edges which are provided with guide slots in the manner of a comb, or by having the guide slots closed by heat beading.

According to a further development of the invention, spacer elements are formed on the boundary edge of the guide comb and/or of the support member which edge is turned toward the printed wiring board. These spacer elements ensure that the boundary edge of the guide comb or of the support member is not supported on a large area of the printed wiring board. This prevents tin from penetrating by capillary action between the printed wiring board and the boundary edge during the soldering and thus prevents electrical short circuits from being caused by solder particles. Moreover, the spacer elements on the guide comb ensure that the forces exerted in slipping the plug board into the female multipoint connector after the soldering are not transmitted to the soldered junction between contact pins and printed wiring board.

BRIEF DESCRIPTION OF THE DRAWINGS

The invention is explained in the following on the basis of first and second embodiments represented in the drawings. In these.

BEST MODE FOR CARRYING OUT THE INVENTION

Figure 1:
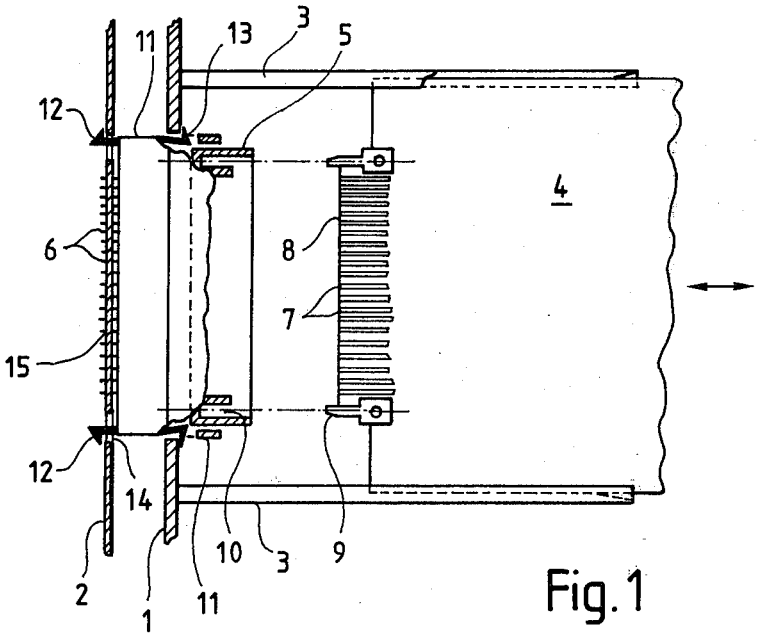
FIG. 1 shows a diagrammatic section representation of the connector unit according to the first embodiment of the invention.

FIG. 1 shows a section of a stationary rack 1 which on the back side of the rack is provided with a large-area printed wiring board 2 with wiring not further represented or with printed conductors, and on the front side of the rack is provided with guide bars 3 fastened in pairs onto the rack 1, between which the plug-in modules 4 can be plugged in and withdrawn in the direction of the arrow. In general 5 as a whole designates a female multipoint connector which is equipped with rows of contact clips 6, with the contact ends of which, on the front side of the rack, which are not further represented in FIG. 1, contact can be made with the corresponding opposite contact 7 of the spring contact strip 8, attached to the plug-in module 4 on its plug-in side, by moving the plug-in module 4 in the direction of the arrow. Therewith freely protruding projections 9 of the spring contact strip engage in the corresponding centering grooves 10 on the female multipoint connector 5. Any desired number of guide bars 3 and female multipoint connectors 5 may be arranged for the electrical connection of many plug-in modules next to one another or one over another on the rack 1. FIG. 1 diagrammatically shows a support member 11 surrounding the female multipoint connector 5 on four sides, which board extends to the printed wiring member 2 and which on opposite boundary sides has at least two pairs of catch hooks with catch hooks 12 and 13 which lock in opposite directions, wherewith the catch hooks 12 hook onto the outer boundary surface of the printed wiring board 2 in the corresponding openings 14, whereas the hook catches 13, introduced into suitable, e.g. rectangular, openings in the rack 1 along with the support member 11, catch onto the front-side boundary surface of the rack 1. If the plug-in module 4 is plugged in, the catch hooks 13 absorb the insertion forces and transmit them to the stable rack 1, whereas when the plug-in module 4 is pulled out the pull-out forces are transmitted by way of the catch hook 12 to the printed wiring board 2. The printed wiring board 2 is supported by way of fastening elements which are not shown, on the back-side boundary surface of the rack 1, so that the pulling-out forces are likewise transmitted to the latter. Designated as 15 are the junctions or soldered junctions between the ends of the contact clips 6 and the printed conductors of the printed wiring board 2.

Figure 2:
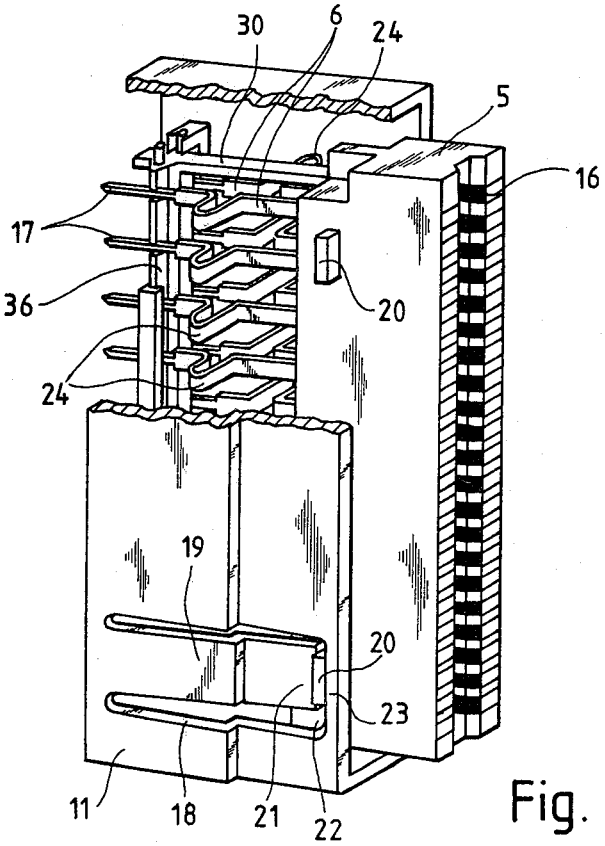
FIG. 2 shows a perspective view of a female multipoint connector of the connector unit according to FIG. 1 in an enlarged representation.
Figure 3:
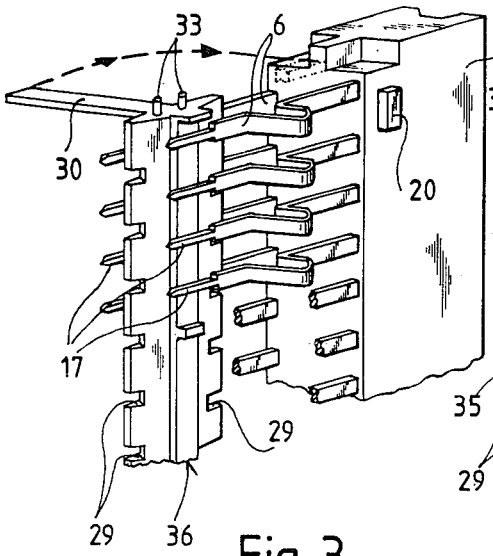
FIGS. 3 and 4 show the back elevation of the female multipoint connector according to FIG. 2 with a guide comb inserted between its contact clip ends, in two different installation positions.
Figure 4:
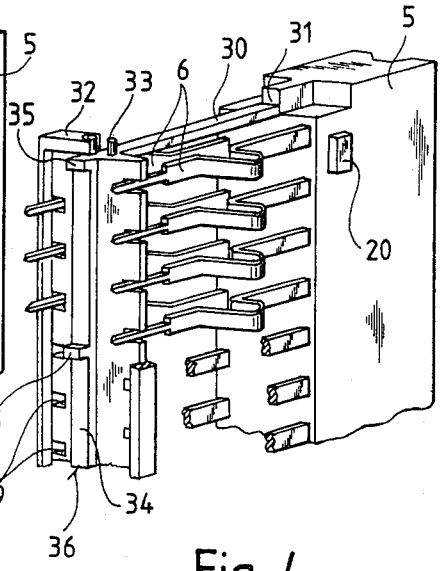

In FIGS. 2, 3, and 4 the female multipoint connector 5 equipped with rows of contact clips 6 is represented as a unit. The female multipoint connector 5 made of insulating plastic possesses guide channels, not further represented, for the contact clips 6 arranged in two rows, spaced apart from one another, which are vertical in the figure. The contact clips 6, which are described in more detail below, protrude freely out over the female multipoint connector 5 on the back side of the connector and are supported by wipers 16 and 16' (FIGS. 5 and 6), having a forked shape in corresponding recesses of the female multipoint connector 5 in such a way that they are freely accessible for the corresponding opposite contact of the spring contact strip 8 of the plug-in module 4 for the contacting process. On the other end the contact clips 6 possess narrow connection ends in the form of contact pins 17, where the contact pins 17 of the whole of the contact clips are located in one plane. The female multipoint connector 5 is surrounded on four sides, with a clearance, by the support member 11 (FIG. 2), which on the front side is overlapped by the female multipoint connector 5 and on the back side by the contact pins 17 of the contact clips 6. As explained above, this support member 11 possesses the catch hooks 12 and 13 not represented in FIG. 2 for securing the latter to the printed wiring board 2 on the one hand and to the rack 1 on the other hand. On the opposite boundary sides of the support member 11 are provided spring flaps 19, which are formed by punched perforations 18 and are integral with the support member 11, and are bent in advance for the hollow space inside the support member 11. These spring flaps 19 opposite one another are supported on the lateral boundaries of the female multipoint connector 5 and thus form the floating support for the female multipoint connector 5. In FIG. 2, it is apparent that two spring flaps 19, one above another, are situated on each boundary side of the support member 11. Correspondingly, the female multipoint connector 5 possesses two rectangular formed-on projections 20 on each boundary side. These projections are guided in the slots 22 formed by punched perforations 18 of the spring flaps 19 and extending along the free spring ends 21, guided in such a way that they are retained in the plug-in direction of the plug-in module 4 by the fillet 23 of the support member 11 or by the free spring end 21 of the corresponding spring flap 19, while they can be moved perpendicularly to the plug-in direction in accordance with the width of the slot 22.

Figure 5:
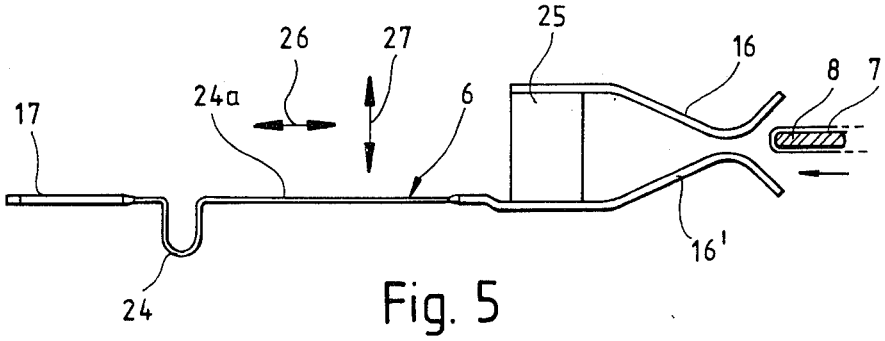
FIGS. 5 and 6 show the enlarged representation of a single contact clip of the female multipoint connector according to FIGS. 2 to 4 in a top plan view and a side view.
Figure 6:
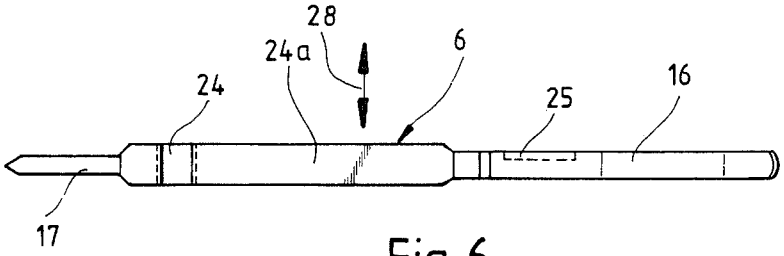

FIGS. 5 and 6 show a contact clip 6 as a unit. In the embodiment example the flat-belt-shaped contact clip 6 in the region between the contact pin 17 and the wipers 16 is formed out in such a way that it forms a semicircularly rounded spring loop 24. Moreover, the contact clip 6 has a lateral projection 25 onto which a wiper 16 bent perpendicularly to this is formed, which stands opposite to a corresponding wiper 16' on the base material of the contact clip 6, in the manner of a fork. Between these fork-like, flexible wipers 16 and 16', as explained, the spring contact strip 8 of the plug-in module 4 can be inserted. As FIG. 6 in particular shows, the flat-belt-shaped material of the contact clip 6 is designed tapered in the region of the wiper 16 or 16' and of the contact pin 17. Besides this, the contact clip 6 is broadened and reduced in the thickness of its material in the region of its shank 24*a* so that the cross section is always the same, which substantially improves the spring action. Arrows 26, 27 and 28 in FIGS. 5 and 6 denote that by reason of the special design of the contact clip 6, this is flexibly yielding toward bending forces acting in all directions, i.e. that because of the presence of the spring loop 24, the contact clip 6 can bend thoroughly and so flexibly in its center region, when motion forces act on the wipers 16 and 16', that these forces are transmitted to the contact pin 17 to only a negligible degree.

The contact clips 6 discussed are mounted in the female multipoint connector 5 in such a way that the spring loops 24 of the two rows of contact clips mounted parallel to one another are turned away from one another. In FIGS. 2,3 and 4, 36 designates a guide comb which in this embodiment example shows boundary edges running in a wedge shape on both sides, in which edges are incorporated successive comb-like guide grooves 29 in which the contact-side ends of the contact clips 6 fit in a form-locking manner. For its installation, the guide comb is first inserted by its flat side between the connection-side ends or between the contact pins 17 of the contact clips 6, as FIG. 3 shows. Then, as is shown in FIG. 3 by an arc-shaped broken line, the guide comb is rotated by 90°, in which way the ends of the contact clips come into the guide slots 29 and are retained thereby. At the same time, freely projecting fixing brackets formed on both sides of the guide comb 36 are secured in a form-locking manner in the corresponding grooves 31 in the upper and lower end of the female multipoint connector 5, in which way the guide comb 36 and also the contact clip ends are relatively locked with respect to the female multipoint connector 5. An additional locking for the ends of the contact clips is provided by U-shaped retaining strips 32 which can be placed on the opposite boundary edges of the guide comb 36 and can be secured onto pins 33. By means of these retaining strips 32 the guide slots 29 are closed from the outside. Instead of the ends of the contact clips being locked by the retaining strips 32, the guide slots 29 can also be closed by heat beading and thus the contact pins 17 be fitted in them. This eliminates the retaining strips 32 and pins 33. Finally, the guide comb 36, in the region of its central fillet 34, has rectangular spacer elements 35 on which the guide comb and with this the female multipoint connector 5 connected with the guide comb 36 are supported on the printed wiring board 2, in which way a large surface area of support of the guide comb is avoided, and so is the formation of vertical leakage paths.

When the plug-in module 4 is plugged into the female multipoint connector 5, as was mentioned, the plugging-in forces are transmitted by way of the catch hooks 13 to the stable rack 1. At the same time, the female multipoint connector 5, because of its floating mounting, has the capability of adapting itself to the plug-in path of the plug-in module 4. The forces arising from the motion of the female multipoint 5 perpendicularly to the plug-in direction cannot be transmitted to the soldered junctions 15 (FIG. 1) by reason of the special design of the contact clips 6. The soldered junctions thereby remain very largely unstressed and unstrained even under extreme deflection motions of the female multipoint connector 5.

Figure 7:
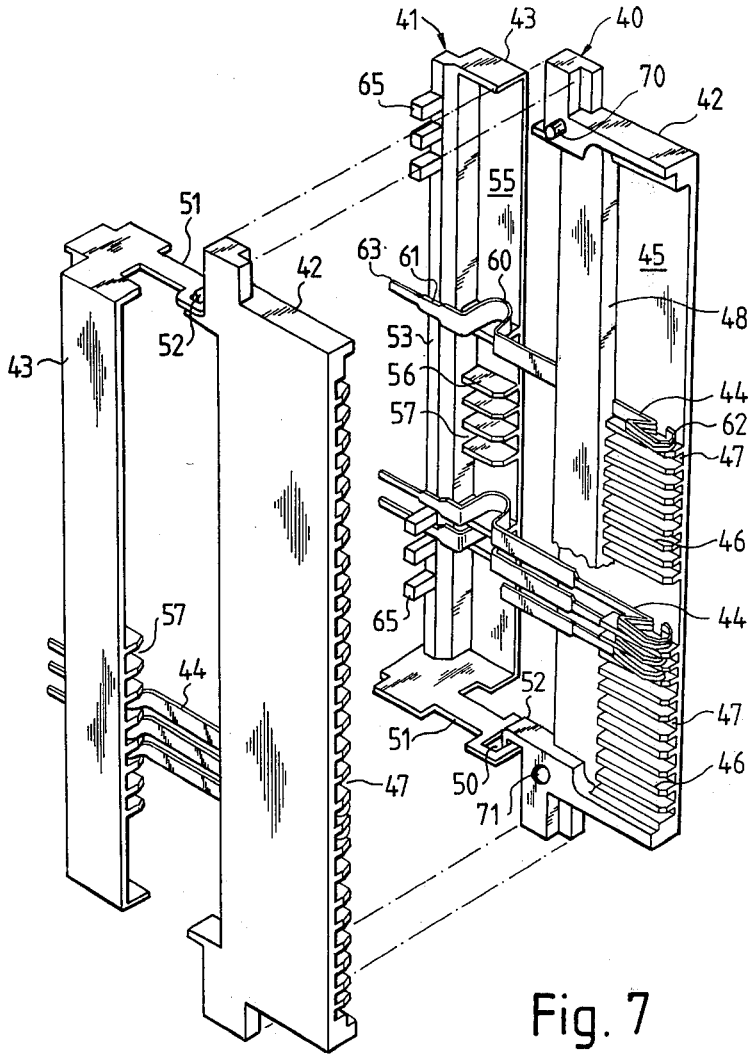
FIG. 7 shows a connector unit according to the second and preferred embodiment in a perspective pulled-apart representation.

FIG. 7 shows a connector unit with a female multipoint connector 40 and a support member in the form of a contact clip guide 41 in their state immediately before their fitting together. The female multipoint connector 40 has two half connectors 42, the contact clip guide 41 has two half connectors 43. Each half connector along part of its width is divided by transverse flanges 46 and 56 into a plurality of chambers 47 and 57 in which contact clips 44 are arranged. The contact clips 44 here are placed opposite one another in pairs, i.e. the chambers 47 and 57 of the two respective half connectors 42 are placed opposite one another after the half connectors 42 and 43 are joined together.

The half connectors 42 of the female multipoint connector 40 are each provided with a retaining strip 48 which is put on the lengthwise surface 45 in such a way that it secures or fixes the contact clips 44 onto it. After the contact clips are inserted into the chambers 47, the retaining strip 48, which like the female multipoint connector 40 suitably consists of plastic, for example of glass fiber laminated polycarbonate, is unreleasably attached to the respective half connector 42 by welding.

It is seen from FIG. 7 that the contact clips 44 show an approximately semicircular bend 60 which is arranged in the respective chamber 56 of a half connector 43 of the contact clip guide 41. The contact clips are placed with their rear segment 61 on a lengthwise flange 53 of the respective half connector 43 of the contact clip guide 41, which seals off the lengthwise surface 55 of the half connector 43 and delimits the chambers 57. The contact clips 44 are fixed onto this lengthwise flange 53 in a manner yet to be described. To maintain a mutual spacing between the contact clip segments 61, teeth 65 are used which impinge on one another when the two half connectors 43 are mutually joined together. It is also possible to provide only one half connector with teeth 65.

The contact clips 44 have a front contact segment 62 which is divided by lengthwise slots into two halves in order to increase the reliability of making contact when a plug-in module is plugged in.

It is also seen from FIG. 7 that the half connectors 42 of the female multipoint connector 40 show a pin 70 at one end and a corresponding bore 71 at the other. The respective pin 70 of the one half connector 42 is opposite a bore 71 of the other half connector 42. These elements permit a satisfactory mutual alignment of the two half connectors 72 with one another when they are joined together and, for example, are welded to one another.

The contact clips 44 project out of the contact clip guide 41 by their contact pins 63 and can be soldered or otherwise joined by these contact pins to a printed wiring board.

The contact clip guide 41 is coupled with the female multipoint connector 40 with play. For this purpose a support 51 is provided at one end of each half connector 43 of the contact clip guide 41, so that the contact clip guide 41 shows one support 51 at each end after the two half connectors 43 have been joined together. The support 51 is provided at its free end with an opening 50, rectangular for example, which is suspended on a detent 52 on the particular half connector 42 of the female multipoint connector 40. On each female multipoint connector 42 there is only one such detent 52 provided at one end, and this in such a way that, as with the contact clip guide 41, after the half connectors 42 have been joined together there is one detent 52 situated at each end of the female multipoint connector.

The opening 50 is dimensioned so that the respective detent 52 is inserted in it with play and a floating mounting of the female multipoint connector in a rack is possible without the contact clip guide 41 being moved too during any possible movements of the female multipoint connector 40. The bends 60 in the contact clips 44 absorb any possible movements of the female multipoint connector 40, but are retained in their chambers 57 in such a way that the mutual orientation and alignment of the contact clips 44 is not disturbed.

Figure 8:
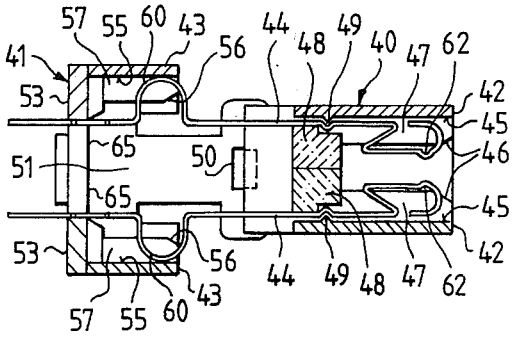
FIG. 8 shows a horizontal section of the connector unit according to FIG. 7.

FIG. 8 shows a horizontal section of the connector unit represented in FIG. 1 after it has been joined together. This section lies in one plane through two opposite contact clips 44. It can be seen that each contact clip 44 shows a crease with which it rests on a lengthwise rib 49 which is arranged on the lengthwise surface 45 of the respective half connector 42 of the female multipoint connector 40. The retaining strip 48 is provided with a gradation such that with one part of its lengthwise surface it rests on the crease of the contact clip 44 and with another part of its lengthwise surface it lies on the segment behind the crease, and thus the contact clip 44 is reliably secured against any lengthwise shifts on the lengthwise surface 45 of the respective half connector 42. Moreover it may be seen that the respective bend 60 of a contact clip 44 is retained in its chamber 57 of the contact clip guide 41, but the contact clip 44 itself does not lie in the chamber 57. The chamber 57 therefore serves for receiving the bend 60 and effects a guiding of this part of the clip 44 in case of any relative movements between the female multipoint connector 40 and the contact clip guide 41.

FIG. 8 shows further that the contact segments 62 of the contact clips 44 project out of the chambers 47 of the female multipoint connector 40 and stand opposite one another with about the spacing of a rack-and-panel connector of a printed circuit card. They permit making contact on both sides of the rack-and-panel connector when the latter is pushed into the intermediate space formed between them.

In FIG. 8 it is moreover represented that the half connectors 42 and 43 are connected with one another practically jointlessly at the positions where their elements 48 and 65 lie against one another. In the case of fabrication out of plastic this joint can advantageously be made by ultrasonic welding.

Figure 9:
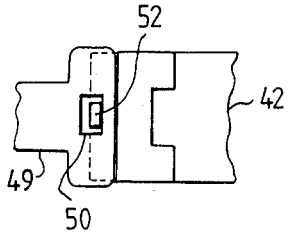
FIG. 9 shows a clearer representation of the coupling between contact clip guide and female multipoint connector.

FIG. 9 shows a view of the coupling between the female multipoint connector and the contact clip guide as seen from the outside of the connector unit. The support 49 is suspended by its opening 50 in the detent 52 on the half connector 42, and it may be seen that the detent 52 is substantially smaller than the opening 50. Therefore the female multipoint connector can execute movements relative to the contact clip guide the degree of which movements is determined by the relation in size between the detent 52 and the opening 50.

Figure 10:
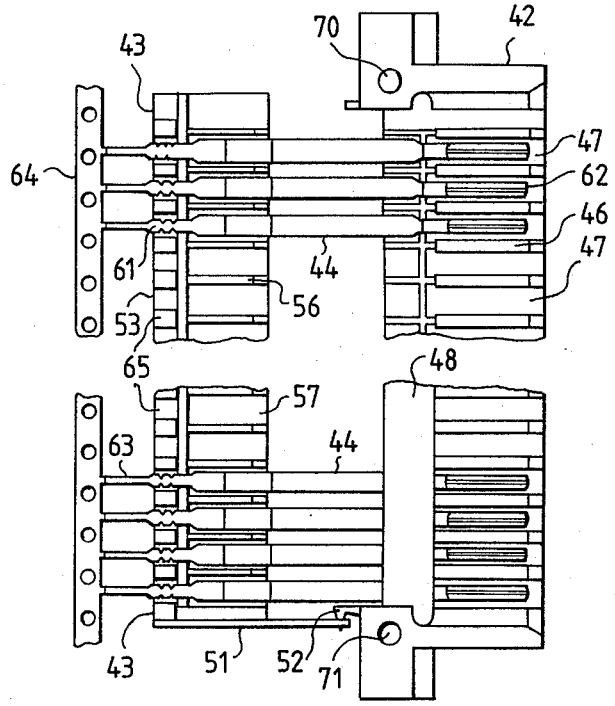
FIG. 10 shows a partly broken top plan view of the arrangement of contact clips in the chambers of the contact clip guide and the female multipoint connector.

FIG. 10 shows a top plan view, partly broken apart, of the inside of one half of the connector unit. Here the arrangement of the contact clips with their contact segments 62 having a lengthwise spacing in the chambers may be seen. The half connector 42 has on its lower end a detent 52 and a bore 71 and on its upper end it has a pin 70. Moreover it may be seen that the transverse flanges 46 of the half connector 42 are accurately aligned with the transverse flanges 56 of the half connector 43. The contact clips 44 have teeth in the segment 61 which rests on the lengthwise flange 53, in order to improve their fixing on the lengthwise flange 53.

FIG. 10 shows moreover that the contact clips 44 after their fabrication may also be joined to one another with an edge band 64 by means of punching off, which keeps them spaced apart by a distance corresponding to the mutual spacing apart of the chambers 47 and 57. This permits a very easy insertion of the contact clips in the chambers 47 and 57 before the half connectors 42 and 43 are joined together or the retaining strips 48 are inserted. After the joining together of the connector unit the edge bands 64 can then be punched off, so that the outer ends 63 of the contact clips stand ready for joining with a printed wiring board.

We claim:

1. Electrical connector unit with a female multipoint connector attachable onto a frame, the contact clips of which connector, which are constructed flexibly yielding in a plurality of directions and situated opposite one another by pairs in two rows, on the one hand are electrically connected, for example by soldering, with printed conductors of a printed wiring board and on the other hand are capable of making contact with electrical plug-in modules which can be plugged into the female multipoint connector, characterized in that the contact clips (6) show deformations (24), producing flexibility, in the region between the female multipoint connector (5) and a contact clip guide (36), which guide is arranged in front of the printed wiring board (2) and can be coupled with the female multipoint connector (5), and the clips are directly connected with the printed conductors of the printed wiring board (2).

2. Electrical connector unit as claimed in claim 1, further comprising a rack (1) having means (3) for slidably receiving said plug-in modules (4), a support member (11) mediate the female multipoint connector (5) and the board (2) and having at least two catch hooks (12, 13) locking in opposite directions for locking onto the rack (1) on the one hand and onto the printed wiring board (2) on the other.

3. Electrical connector unit as claimed in claim 2, characterized in that the female multipoint connector (5) is mounted floating between two spring flaps (19) formed on at least two opposite sides of the support member (11).

4. Electrical connector unit as claimed in claim 3, characterized in that the female multipoint connector (5) is supported for limited vertical motion in the support member (11) by slots (22) extending perpendicularly to the plug-in direction of the plug-in module (4), and by means of projections (20) on the connector (5), which projections (20) fit into said slots (22).

5. Electrical connector unit as claimed in claim 4, wherein slots (22) are formed by punched performations (18) surrounding the spring flaps (19).

6. Electrical connector unit as claimed in claim 1, characterized in that each of the contact clips (6) is formed to exhibit at least one meander-shaped spring loop (24) between the opposite ends thereof.

7. Electrical connector unit as claimed in claim 6, characterized in that the contact clip (6) is formed of a flat-belt-shaped material and is twisted by about 90° between the connecting and contact point.

8. Electrical connector unit as claimed in claim 7, characterized in that the contact clip (6) is broadened and reduced in thickness in the region of its shank (24*a*).

9. Electrical connector unit as claimed in claim 8, characterized in that each contact clip (6) has a lateral projection (25) and two fork-like flexible wipers (16,16') on the contact end.

10. Electrical connector unit as claimed in claim 1 further including a guide comb (36) having guide slots (29) for the contact clips (6).

11. Electrical connector unit as claimed in claim 10, characterized in that the guide comb (36) is disposed between the ends of the contact clips (6) and is pivoted in grooves (31) of the female multipoint connector (5).

12. Electrical connector unit as claimed in claim 11, further comprising retaining strips (32) pivotally connected to the guide comb (36).

13. Electrical connector unit as claimed in claim 10, further comprising spacer elements (35) formed onto an edge (34) of the guide comb (36) which edge is turned toward the printed wiring board (2).

14. Electrical connector unit with a female multipoint connector attachable onto a rack, the contact clips of which connector, which are constructed flexibly yielding in a plurality of directions and situated opposite one another by pairs in two rows, on the one hand are electrically connected, for example by soldering, with printed conductors of a printed wiring board and on the other hand are capable of making contact with electrical plug-in modules which can be plugged into the female multipoint connector, wherein the contact clips show deformations producing flexibility in the region between the female multipoint connector and a contact clip guide which is arranged in front of the printed wiring board and can be coupled with the female multipoint connector, and the contact clips are directly connected with the printed conductors of the printed wiring board, characterized in that the female multipoint connector (40) and the contact clip guide (41) each consist of two similar half connectors (42,43) connected to one another after the insertion of the contact clips (44) of one series, which connectors for each contact clip (44) have one chamber (47,57) formed out of the lengthwise side (45,55) of the half connector (42,43), that the chambers (57) of the contact clip guide (41) receive only the deformation (60) of the respective contact clip (44) and that the contact spring guide (41) is coupled with play with the female multipoint connector (40).

15. Connector unit as claimed in claim 14, characterized in that each half connector (42) of the female multipoint connector (40) is provided with a retaining strip (48) for fixing the contact clips (44) which strip is placed behind their contact segments (62) in the plug-in direction and on the contact clips (44) in the lengthwise direction of the half connector (42) and is firmly attached to it.

16. Connector unit as claimed in claim 15, characterized in that each half connector (42) of the female multipoint connector (40) shows a lengthwise rib (49) turned toward the contact clips (44) and situated under the retaining strip (48), on which is placed the respective contact clip (44) with a crease formed into it.

17. Connector unit as claimed in claim 16, characterized in that the retaining strip (48) shows a gradation of such a kind that it rests on the crease on the one hand and rests on a segment of one contact clip (44) behind the crease, on the other.

18. Connecting unit as claimed in claim 14, characterized in that at least one half connector (43) of the contact clips guide (41) shows a lengthwise flange (53) behind their chambers (57) in that plug-in direction, on which flange the contact clips (44) rest and which shows teeth (65) between each two contact clips (44), which teeth can be coupled with the teeth (65) opposite them in the other half connector (43) or with its lengthwise flanges (53).

19. Coupling unit as claimed in claim 18, characterized in that the contact clips (44) are toothed in the segment of these resting on the lengthwise flange (65).

20. Connector unit as claimed in claim 14, characterized in that the half connectors (42,43) are provided on one end each with a coupling element (51, 52) for connecting female multipoint connector (40) and contact clip guide (41) in such a way that a coupling occurs on both ends of the unit.

21. An electrical connector unit for plug-in circuit modules (4) of the type having multiple edge contacts comprising:

A female multipoint connector (5) adapted to receive said modules (4) and having a plurality of contact clips (6) arranged in a row with one end making contact with said edge contacts and the other end being connected to the conductors of a wiring board (2);

said contact clips (6) having deformations (24) between the ends thereof to permit elastic yielding in plural directions;

a contact clip guide (36) mediate the multipoint connector (5) and the wiring board (2) but mounted on the multipoint connector for holding the other ends of the contact clips (6) in position;

and support means (11) for yieldably holding the multipoint connector (5) to permit limited movement thereof during the insertion and removal of a module (4) even though the other ends of the contact clips (6) are firmly connected to said board (2).

22. Electrical connector unit as claimed in claim 21, further comprising a rack (1) having means (3) for slidably receiving said plug-in modules (4), said support means (11) being mediate the female multipoint connector (5) and the board (2) and having at least two catch hooks (12, 13) locking in opposite directions for locking onto the rack (1) on the one hand and onto the printed wiring board (2) on the other.

23. Electrical connector unit as claimed in claim 22, characterized in that the female multipoint connector (5) is mounted floating between two spring flaps (19) formed on at least two opposite sides of the support member (11).

24. Electrical connector unit as claimed in claim 23, characterized in that the female multipoint connector (5) is supported for limited vertical motion in the support member (11) by slots (22) extending perpendicularly to the plug-in direction of the plug-in module (4), and by means of projections (20) fit into said slots (22).

25. Electrical connector unit as claimed in claim 24, wherein slots (22) are formed by punched performations (18) surrounding the spring flaps (19).

26. Electrical connector unit as claimed in claim 21, characterized in that each of the contact clips (6) is formed to exhibit at least one meandershaped spring loop (24) between the opposite ends thereof.

27. Electrical connector unit as claimed in claim 26, characterized in that the contact clip (6) is formed of a flat-belt-shaped material and is twisted by about 90° between the connecting and contact point.

28. Electrical connector unit as claimed in claim 27, characterized in that the contact clip (6) is broadened and reduced in thickness in the region of its shank (**24*a***).

* * * * *